US006805245B2

(12) United States Patent
Kenneway

(10) Patent No.: US 6,805,245 B2
(45) Date of Patent: Oct. 19, 2004

(54) OBJECT SORTING SYSTEM

(75) Inventor: Ernest K. Kenneway, Ada, MI (US)

(73) Assignee: Dunkley International, Inc., Kalamazoo, MI (US)

( * ) Notice: Subject to any disclaimer, the term of this patent is extended or adjusted under 35 U.S.C. 154(b) by 212 days.

(21) Appl. No.: 10/041,643

(22) Filed: Jan. 8, 2002

(65) Prior Publication Data

US 2003/0127372 A1 Jul. 10, 2003

(51) Int. Cl.[7] ..... B07L 5/02

(52) U.S. Cl. ..... 209/538; 209/844; 209/587; 209/639; 209/555

(58) Field of Search ..... 209/538, 577, 209/587, 639, 638, 576, 518, 555, 44.1, 44.2; 198/416; 414/431

(56) References Cited

U.S. PATENT DOCUMENTS

| | | | | |
|---|---|---|---|---|
| 4,281,933 A | | 8/1981 | Houston et al. | |
| 4,707,251 A | * | 11/1987 | Jenkins et al. | 209/569 |
| 4,726,898 A | * | 2/1988 | Mills et al. | 209/545 |
| 4,884,696 A | | 12/1989 | Peleg | |
| 5,085,510 A | * | 2/1992 | Mitchell | 356/237.1 |
| 5,147,047 A | * | 9/1992 | Ahmed et al. | 209/538 |
| 5,267,654 A | * | 12/1993 | Leverett | 209/538 |
| 5,366,096 A | * | 11/1994 | Miller | 209/535 |
| 5,405,015 A | * | 4/1995 | Bhatia et al. | 209/524 |
| 5,443,164 A | * | 8/1995 | Walsh et al. | 209/580 |
| 5,505,312 A | * | 4/1996 | Haring et al. | 209/524 |
| 5,522,512 A | | 6/1996 | Archer et al. | |
| 5,626,236 A | * | 5/1997 | Hiebert | 209/538 |
| 5,887,073 A | | 3/1999 | Fazzari et al. | |
| 5,893,465 A | | 4/1999 | Harangozo | |
| 5,901,854 A | * | 5/1999 | Ishii | 209/538 |
| 5,960,098 A | | 9/1999 | Tao | |
| 5,982,921 A | | 11/1999 | Alumot et al. | |
| 6,005,959 A | | 12/1999 | Mohan et al. | |
| 6,031,931 A | | 2/2000 | Chiu et al. | |
| 6,610,953 B1 | * | 8/2003 | Tao et al. | 209/577 |

OTHER PUBLICATIONS

TVI Products (2 pgs.), http://www.tvivision.com/Product-s.html, Jun. 2, 2000.
TVI Food Industry (3 pgs.) http://www.tvivision.com/Food_Industry.html, Jun. 2, 2000.
TVI Metal Recycling (1 pg.) http://www.tvivision.com/Metal_Recycling.html, Jun. 2, 2000.
TVI Mineral Industry (2 pgs.), Http://www.tvivision.com/Mineral_Industry.html, Jun. 2, 2000.
TVI Paper Recycling (2 pgs.), http://www.tvivision.com/Paper_Recycling.html, Jun. 2, 2000.
SI Product Concept (2 pgs.), http://www.baslerweb./com/en/products/si/variant.html, Jun. 2, 2000.
SI Product Concept (2 pgs.), http://www.baslerweb.com/en/products/si/variantl.html, Jun. 2, 2000.
SI Product Concept (2 pgs.), http://www.baslerweb.com/en/products/si/variant2/html, Jun. 2, 2000.
SI Product Concept (2 pgs.), http://www.baslerweb.com/en/products/si/variant3.html, Jun. 2, 2000.

(List continued on next page.)

*Primary Examiner*—Donald P. Walsh
*Assistant Examiner*—M Kohner
(74) *Attorney, Agent, or Firm*—Price, Heneveld, Cooper, DeWitt & Litton, LLP

(57) ABSTRACT

An object sorting system automatically inspects a plurality of objects and sorts acceptable objects from defective objects. The system includes a feed conveyor, a barrier, a sorting camera, at least one rejection valve and a processor. The feed conveyor receives a plurality of objects and moves the objects through an inspection area, which is defined by the barrier, which is placed across and above a top surface of the feed conveyor. The barrier is configured to redirect the plurality of objects and cause the objects to rotate about an object axis such that the sorting camera can capture an image of each of the plurality of objects as the objects rotate and move through the inspection area.

27 Claims, 5 Drawing Sheets

OTHER PUBLICATIONS

SI Product Concept (2 pgs.), http://www.baslerweb.com/en/products/si/variant4.html, Jun. 2, 2000.
Machine Vision Components (2 pgs.), http://www.baslerweb.com/en/products/mvc/main.html, Jun. 2, 2000.
Product Range (3 pgs.), http://www.baslerweb.com/en/products/mvc/mvc_range.html, Jun. 2, 2000.
Machine Vision Components (2 pgs.), http://www.baslerweb.com/en/products/mvc/prod_range_cmos.html, Jun. 2, 2000.
Technology: Importance (2 pgs.), http://www.baslerweb.com/en/technology/introductions.html, Jun. 2, 2000.
Technology: Examples (3 pgs.), http://www.baslerweb.com/en/technology/examples.html, Jun. 2, 2000.
Technology: How it works (5 pgs.), http://www.baslerweb.com/en/technology/how.html, Jun. 2, 2000.
Technology: Examples (2 pgs.), http://www.baslerweb.com/en/technology/benefits.html, Jun. 2, 2000.
Technology: Examples (2 pgs.), http://www.baslerweb.com/en/technology/importance.html, Jun. 2, 2000.

* cited by examiner

OBJECT SORTING SYSTEM

BACKGROUND OF THE INVENTION

The present invention is generally directed to an object sorting system and, more particularly, to an object sorting system for automatically inspecting a plurality of objects.

Machine vision systems have been utilized in a variety of applications, which include food processing, metal recycling, mineral processing and paper recycling, among other applications. As is well known to one of ordinary skill in the art, vision systems are based on non-contact measurements of electromagnetic radiation (e.g., visible light, infrared light and x-rays), which are typically facilitated by a camera. In the manufacturing and processing environments, it is common to optically inspect and sort individual articles with automatic inspection systems. Many of the inspection systems have determined properties (e.g., color, size and shape) of the articles such that defective articles could be separated from good articles. Machine vision systems have been utilized, for example, to inspect fruit, vegetables and nuts. Machine vision systems have also been utilized in other areas that require a similar sorting of products and/or articles. For example, such systems have been utilized to sort wood chips, aggregates and manufactured products, such as, fasteners and formed objects, in addition to meat products, such as quartered or cubed poultry or beef products.

In a typical system, video images of the products and/or articles are captured, with a camera and a frame grabber, to extract color, shape and/or size related information. Typically, bulk articles are stabilized, using centrifugal force, and conveyed individually past an optical inspection station. In a typical prior art system that implements air deflectors, the center of a defective product is computed such that an air stream is aimed at the center of the product to remove the defective product from a product stream.

Inspection systems have also been designed to inspect various circular parts by dimension and to detect surface defects in the parts. Some of these systems have determined an inside diameter, an outside diameter and detected surface defects, such as nicks, fractures, etc. A wide variety of cameras, which include line scan cameras, area scan cameras and CMOS cameras, have been utilized or proposed for utilization in various inspection systems. Images captured by the cameras are automatically processed and evaluated such that image dependent decisions can be implemented. In prior art systems that have inspected a surface of an object, the object has generally been grasped by an apparatus, which rotates the object such that a camera can inspect the surface of the object. Unfortunately, using an apparatus that has to grasp an object to rotate the object has generally created an inspection bottleneck within such systems.

Thus, what is needed is a practical inspection system that can rotate an object that is to be inspected without seriously impacting system throughput.

SUMMARY OF THE INVENTION

The present invention is directed to an object sorting system for automatically inspecting a plurality of objects and sorting acceptable objects from defective objects. The system includes a feed conveyor, a barrier, a sorting camera, at least one rejection valve and a processor. The feed conveyor receives a plurality of objects and moves the objects through an inspection area. The barrier is placed across a top surface of the feed conveyor and defines a boundary of the inspection area. The barrier is configured to redirect the plurality of objects and, in conjunction with the feed conveyor, cause the objects to rotate about an object axis. The sorting camera is positioned for capturing an image of each of the plurality of objects as the objects rotate and move through the inspection area. The at least one rejection valve functions to direct a finally defective object, such that the finally defective object is separated from inspected acceptable objects. In one embodiment, the processor, which is coupled to the feed conveyor, the sorting camera and the at least one rejection valve executes an inspection routine that controls the speed of the feed conveyor, scanning rate of the sorting camera, and actuation of the at least one final rejection valve. According to another embodiment of the present invention, the barrier includes at least one pair of substantially parallel wires that contain the plurality of objects.

These and other features, advantages and objects of the present invention will be further understood and appreciated by those skilled in the art by reference to the following specification, claims and appended drawings.

DETAILED DESCRIPTION OF PREFERRED EMBODIMENT

According to the present invention, an object sorting system is provided that includes a barrier that is placed and retained across a top surface of a feed conveyor, which moves a plurality of objects through an inspection area. The barrier, in conjunction with the feed conveyor, causes the plurality of objects to rotate about an object axis as the objects move along the barrier. In this manner, a sorting camera, which is positioned for capturing an image of the plurality of objects, can capture images of a surface of each of the objects. The present invention can be utilized to inspect the surface of spherical objects, such as medical balls and ball bearings, and objects with cylindrical surfaces, such as bolts, engine valves and capsules.

Figure 1:
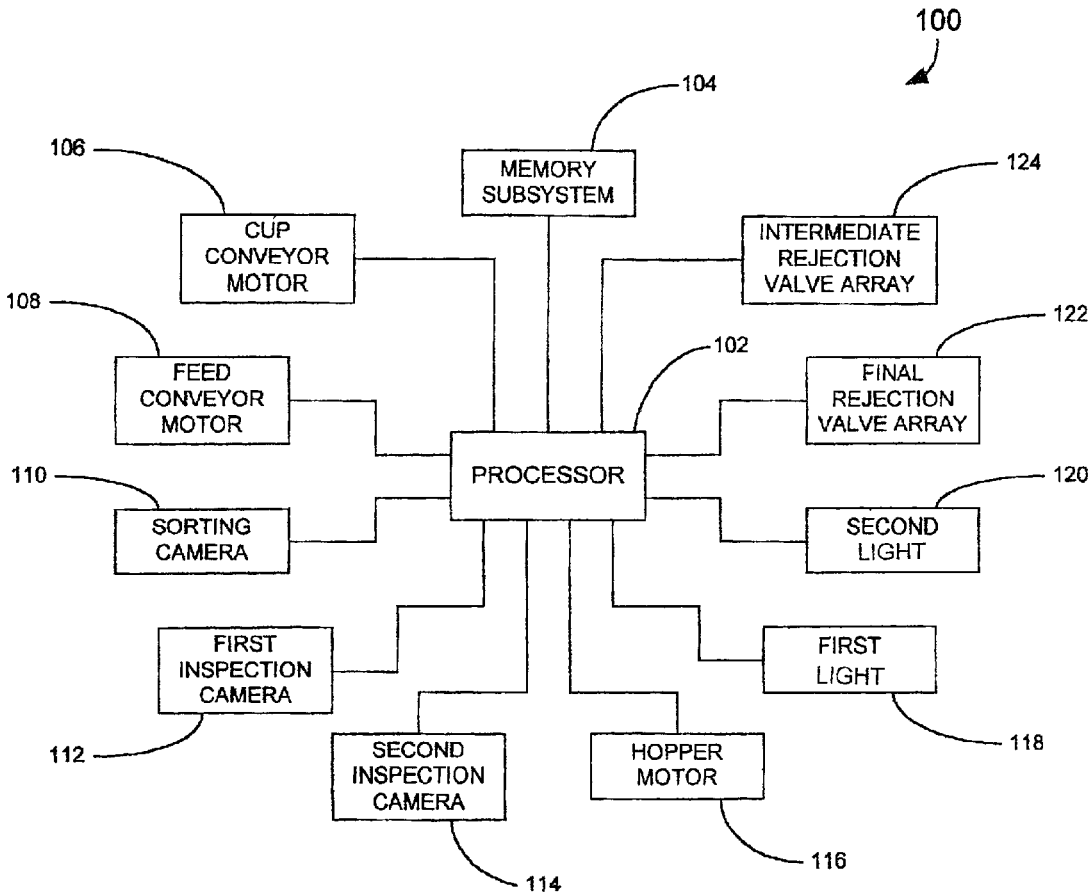
FIG. 1 is an electrical block diagram of an exemplary object sorting system, according to an embodiment of the present invention.

FIG. 1 depicts an electrical block diagram of an object sorting system 100, according to one embodiment of the present invention. A processor 102 is coupled to a memory subsystem 104, which may include an application appropriate amount of volatile (e.g., random access memory (RAM)) and non-volatile memory (e.g., electrically erasable programmable read-only memory (EEPROM)). The processor 102 is also coupled to a cup conveyor motor 106, a feed conveyor motor 108 and a hopper motor 116. In a preferred embodiment, each of the motors 106, 108 and 116 include an encoder, which provides an indication of the speed of an associated one of the motors and hence the associated speed of the feed conveyor, the cup conveyor and the delivery rate of the hopper. As will be further described below in conjunction with FIGS. 2 and 3, the processor 102 controls the delivery of objects from a hopper to a cup conveyor by controlling the speed of the hopper motor 116. The scanning rate of a first inspection camera 112 and a second inspection camera 114 are set in conjunction with the speed of the cup conveyor motor 106.

The processor 102 is also coupled to a first light 118 and a second light 120. The first light 118 may be used in conjunction with the first inspection camera 112 to allow the camera 112 to achieve a wider range of gray scales in a captured image. Similarly, the second light 120 may be utilized in conjunction with the second inspection camera 114 to allow the camera 114 to achieve a wider range of gray scales in a captured image. It should be appreciated that for certain objects, for example, transparent capsules, the second light 120 and the second inspection camera 114 may not be needed. That is, both ends of transparent objects, such as transparent capsules, can generally be inspected with a single camera and a single light. However, to inspect the ends of non-transparent objects, it is generally beneficial to use an inspection camera for each end of the object.

The processor 102 is also coupled to an intermediate rejection valve array 124, which is utilized to remove defective objects from a cup conveyor, whose speed is controlled by the cup conveyor motor 106. According to one embodiment of the present invention, the cup conveyor includes a plurality of open-ended cups that each receive one of a plurality of objects and transports its received object through an intermediate inspection area. The cup conveyor delivers inspected intermediately acceptable objects to a direction chute, which receives the objects and directs them onto a feed conveyor.

The processor 102 is also coupled to the feed conveyor motor 108, which determines the speed of the feed conveyor. A barrier is positioned across the feed conveyor, e.g., set at an angle, so as to cause impinging objects to be carried along the barrier in a rotational manner. A sorting camera 110, which is also coupled to the processor 102, captures images of the rotating objects and may either provide the images to the processor 102 for analysis or may provide an indication to the processor 102 as to whether the captured image or images, as compared to a stored image or images, are acceptable. If the inspected object is acceptable, the object is received in an acceptable object bin, otherwise, the processor 102 actuates one or more final rejection valves of a final rejection valve array 122 to cause a defective object to be separated from acceptable objects and placed in a defective object bin. It should be appreciated that the relationship of the barrier (see FIG. 2), with respect to the feed conveyor, can be modified in conjunction with the speed of the feed conveyor to achieve a desired rotation for a given type of object.

A suitable camera, for sorting and inspection, is manufactured and made commercially available by Basler (Part No. L1GD). A suitable light is manufactured and made commercially available by Illumination Technology (Part No. 3900). A suitable rejection valve is manufactured and made commercially available by MAC (Part No. 52).

Figure 2:
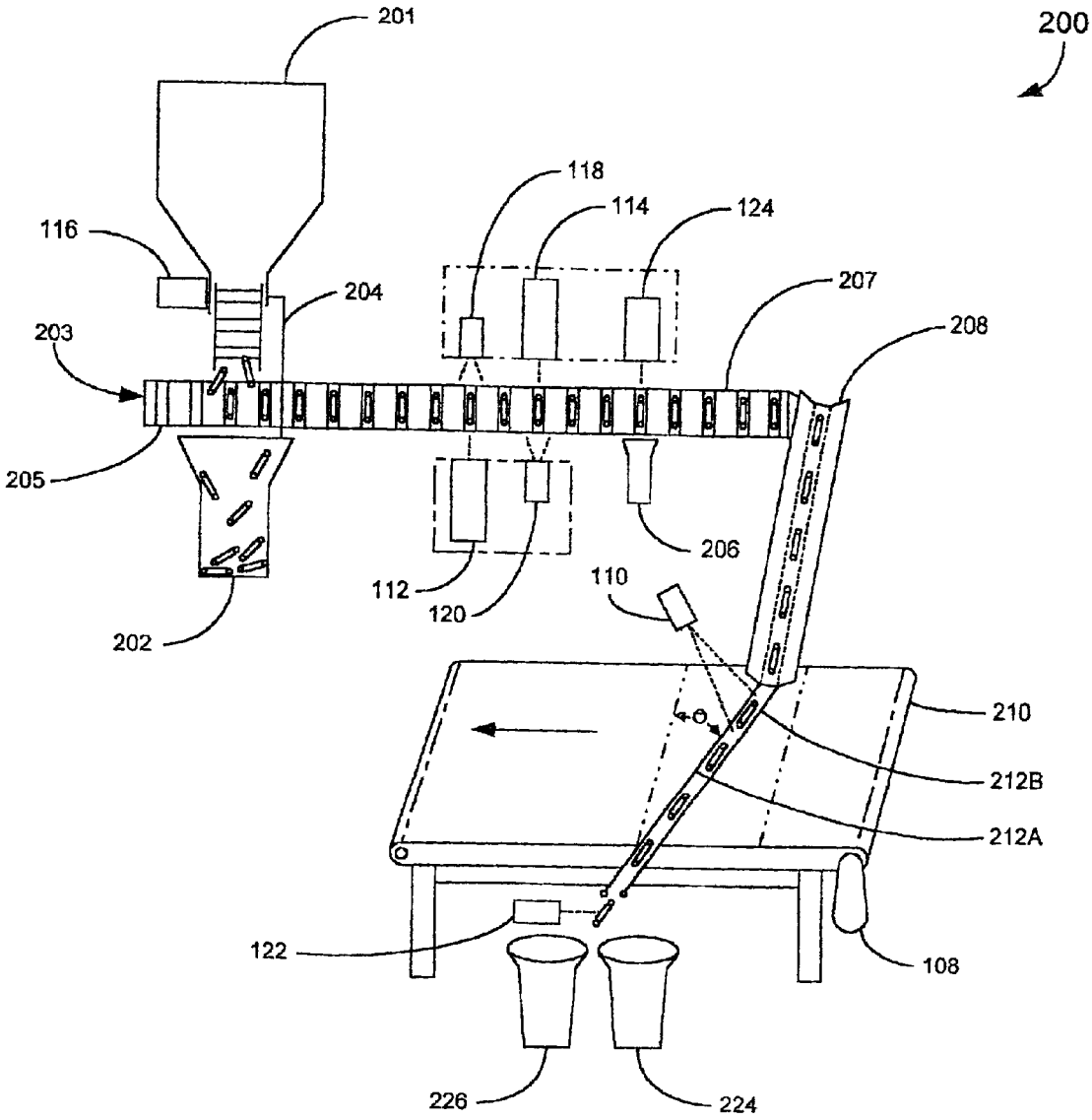
FIG. 2 is a top view of an exemplary object sorting system including a cup conveyor and a feed conveyor, according to another embodiment of the present invention.

FIG. 2 depicts a diagram of an object sorting system 200, according to another embodiment of the present invention. As shown in FIG. 2, a hopper 201, which includes a plurality of uninspected objects, provides the uninspected objects to a cup conveyor 203. The cup conveyor 203 is utilized to transport the plurality of uninspected objects, within open-ended cups 205 of a cup conveyor belt 207, through an intermediate inspection area. An overflow structure 204 is utilized to direct objects that do not find one of the empty cups 205, in the cup conveyor belt 207, into an overflow bin 202. The uninspected objects are then carried through the intermediate inspection area, defined by the cameras 112 and 114. As previously mentioned, it may be beneficial to provide the light 118 for the camera 112 and the light 120 for the camera 114. As shown in FIG. 2, the camera 112 inspects a first end of each of the plurality of objects and the camera 114 inspects a second end of the plurality of objects. Objects with acceptable ends are allowed to pass from the end of the conveyor belt 207 to the feed conveyor 210, via a direction chute 208. It should be appreciated that the cameras 114 and 112 are not generally required to inspect objects without defined ends, e.g., spherical objects, such as medical balls. In this case, the hopper 201 may directly provide the uninspected objects to a direction chute or to a feed conveyor.

At the direction of the processor 102, the intermediate rejection valve array 124, which may include one or more intermediate rejection valves, causes an object with an unacceptable end to be removed from the cup conveyor belt 207 and directed into a rejection bin 206. Objects with acceptable ends are carried down the direction chute 208 and are brought into contact with a first barrier 212A, which prevents the plurality of objects from being carried beyond the barrier 212A. That is, the barrier 212A is spaced an object appropriate distance above a top surface of a belt of the feed conveyor 210 such that the object does not pass under the barrier 212A as the belt of the feed conveyor 210 moves the object along the barrier 212A. Depending upon the object being inspected, it may be beneficial to add a second barrier 212B (to retain the objects within a desired area) parallel to the first barrier 212A and spaced an object appropriate distance from the first barrier 212A.

It should be appreciated that each of the ends of the barriers 212A and 212B are attached to a frame associated with the system 200 or other suitable structure. In one embodiment, the barriers 212A and 212B are parallel wires. However, it should be appreciated that virtually any type of barrier can be utilized as long as the barrier contains the objects within the inspection area. Further, to increase inspection throughput, multiple pairs of barriers (e.g., wires) can be implemented. When the feed conveyor 210 is operational, objects delivered by the direction chute 208 are rotated along the barrier 212A to the edge of the feed conveyor 210. In this manner, the inspection camera 110 can capture an image or images of each of the rotating objects such that the captured image or images can be compared to an acceptable image or images to determine whether a given object passes the inspection process.

Acceptable objects leave the edge of the feed conveyor 210 and are captured in an acceptable object bin 226. When the processor 102 determines that an object is defective, it actuates at least one final rejection valve of the final rejection valve array 122 to cause a given defective object or objects to be directed into a defective object bin 224.

Figure 3:
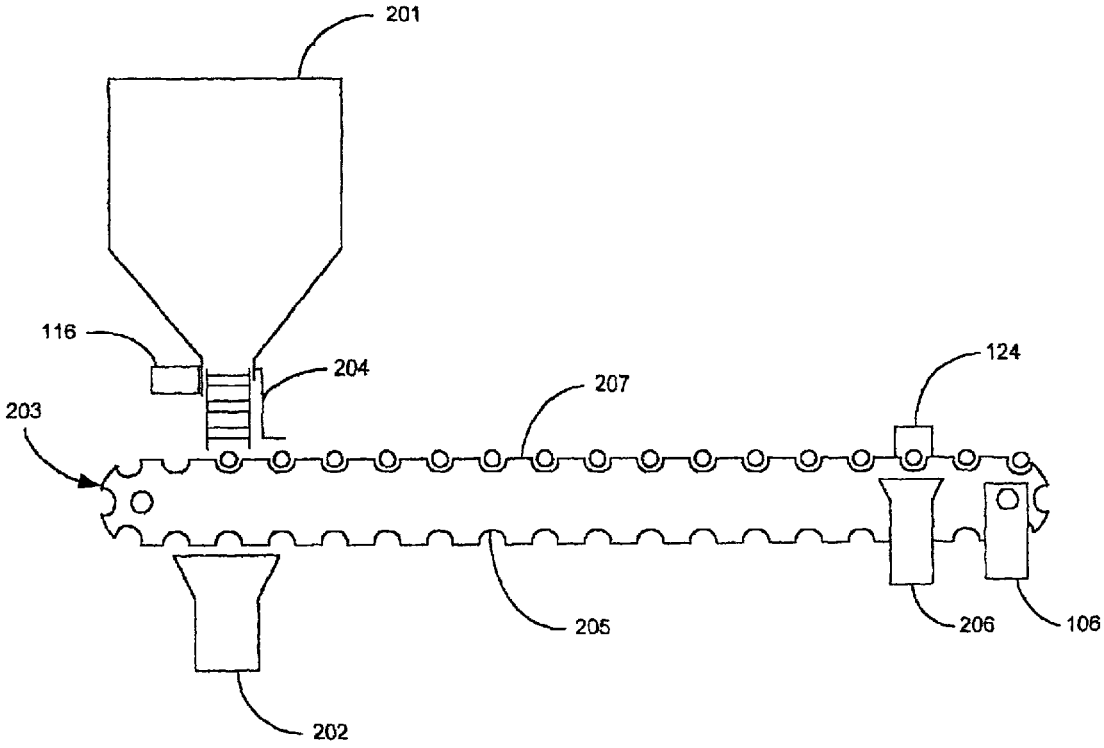
FIG. 3 is a side view of the cup conveyor of FIG. 2 and various associated components, according to one embodiment of the present invention.

FIG. 3 shows a side view of the cup conveyor 203 and various associated components utilized in conjunction with the cup conveyor 203 to perform object inspection. As is best shown in FIG. 3, the belt 207 includes a number of open-ended cups 205, which are designed to receive an object, e.g., a bolt, that requires inspection of its ends. A hopper 201, whose belt is driven by the hopper motor 116 provides the plurality of objects to the cup conveyor 203 such that the objects can be moved through an inspection area. As discussed above with respect to FIG. 2, the overflow structure 204 causes overflow objects to be directed into the overflow bin 202. As is also shown in FIG. 3, an intermediate rejection valve 124 causes defective objects to be directed into a defective object bin 206.

Figure 4:
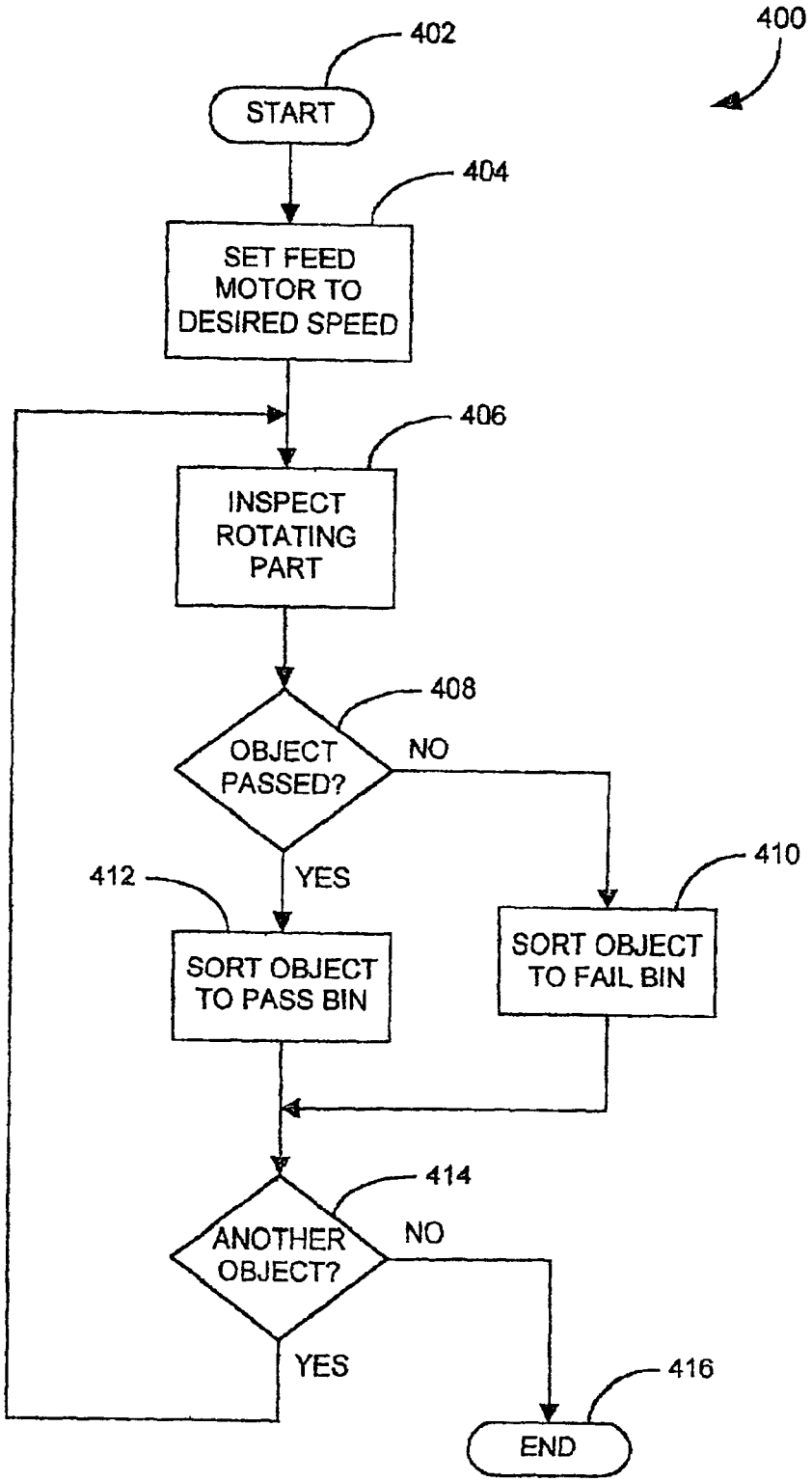
FIG. 4 is a flow chart of an exemplary feed conveyor routine.

FIG. 4 illustrates an exemplary feed conveyor routine 400, according to an embodiment of the present invention. In step 402, the routine 400 is initiated, at which point control transfers to step 404. In step 404, the processor 102 sets the feed conveyor motor 108 to an appropriate speed. Next, in step 406, the processor 102 causes the sorting camera 110 to capture one or more images of a rotating object as it travels along the barrier 212A. As previously discussed, comparison of the captured image to a stored image can be performed by the sorting camera 110, or alternatively, the sorting camera 110 can pass the image(s) to the processor 102 for analysis. Then, in decision step 408, the processor 102 determines whether the object has passed, either by analyzing the image of the object or by receiving an appropriate signal from the sorting camera 110. If the object has passed, control transfers from step 408 to step 412, where the object is sorted to the acceptable object bin 226. Otherwise, control transfers from step 408 to step 410, where the object is sorted to the defective object bin 224. From steps 410 and 412, control transfers to decision step 414, where the processor 102 determines whether another object is to be inspected. If so, control transfers from step 414 to step 406. Otherwise, control transfers from step 414 to step 416, where the routine 400 terminates.

Figure 5:
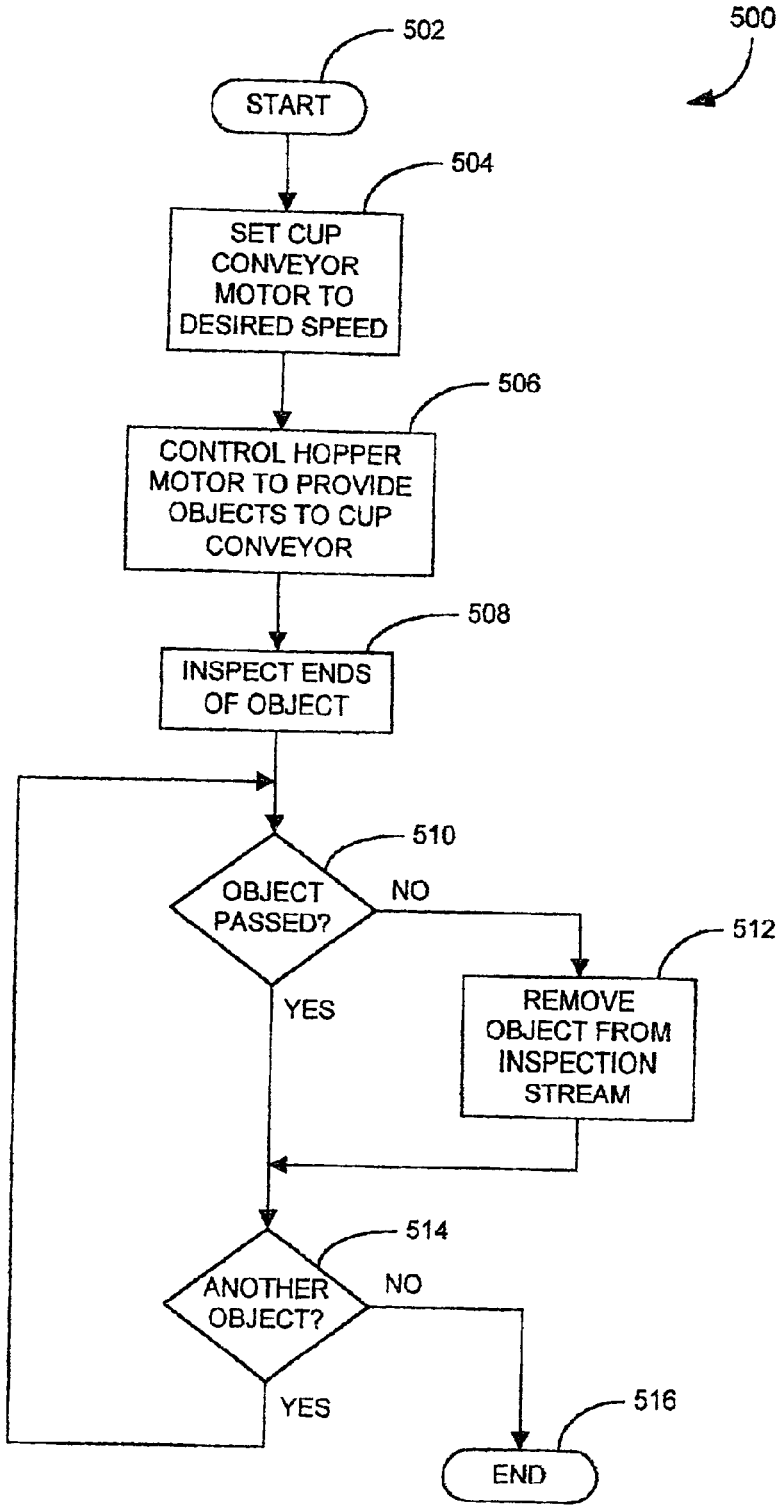
FIG. 5 is a flow chart of an exemplary cup conveyor routine.

FIG. 5 illustrates an exemplary cup conveyor routine 500, according to another embodiment of the present invention. The routine 500 is initiated in step 502, at which point control transfers to step 504. In step 504, the processor 102 sets the cup conveyor motor 106 to a desired speed. Next, in step 506, the processor 102 controls the hopper motor 116 to provide objects to the cup conveyor 203. Then, in step 508, the processor 102 performs an analysis of a captured image or images to determine whether the object currently under inspection has passed inspection. Alternatively, the processor 102 may receive an indication from the cameras 112 and 114 as to whether the object has passed inspection. Next, in decision step 510, the processor 102 determines whether the object passed the inspection. If so, control transfers to decision step 514, where the processor 102 determines whether another object is to be inspected. If so, control transfers from step 514 to step 508. Otherwise, control transfers to step 516, where the routine 500 terminates. In step 510, when the processor 102 determines that the object has not passed, control transfers to step 512 where the processor 102 causes the object to be removed from the inspection stream by actuating an intermediate rejection valve array 124 at which point control transfers to step 514.

Accordingly, an object sorting system has been described herein that is capable of rotating an object (without grasping the object) to determine whether a surface of the object is defective. As is discussed above, this is achieved by placing a barrier across the top surface of the feed conveyor, which, in conjunction with a feed conveyor, moves a plurality of objects through an inspection area. A sorting camera is positioned for capturing an image or images of an object as it is moved through the inspection area and may provide an indication of whether the object is acceptable or provide the image or images to a processor, so that the processor can perform an analysis of the image or images to determine whether the inspected object is defective.

The above description is considered that of the preferred embodiments only. Modifications of the invention will occur to those skilled in the art and to those who make or use the invention. Therefore, it is understood that the embodiment (s) shown in the drawings and described above are merely for illustrative purposes and not intended to limit the scope of the invention, which is defined by the following claims as interpreted according to the principles of patent law, including the Doctrine of Equivalents.

What is claimed is:

1. An object sorting system for automatically inspecting a plurality of objects and sorting acceptable objects from defective objects, the system comprising:

a feed conveyer for receiving a first plurality of objects, the feed conveyor moving the first plurality of objects through an inspection area;

a barrier placed across a top surface of the feed conveyer, wherein the barrier defines a boundary of the inspection area and is configured to redirect the first plurality of objects and cause the first plurality of objects to rotate about an object axis;

a sorting camera positioned for capturing an image of each of the first plurality of objects as the first plurality of objects rotate and move through the inspection area;

at least one final rejection valve, the at least one final rejection valve functioning to separate finally defective objects and inspected acceptable objects; and a processor coupled to the feed conveyer, the sorting camera and the at least one rejection valve, wherein the processor executes an inspection routine that controls a speed of the feed conveyer, a scanning rate of the sorting camera and actuation of the at least one final rejection valve, and wherein the first plurality of objects are one of a bolt, an engine valve, a capsule, a ball bearing and a medical ball.

2. The system of claim 1, wherein an angle at which the barrier is placed across the feed conveyor is adjusted in conjunction with the speed of the feed conveyor to achieve a desired rate of rotation for the first plurality of objects.

3. The system of claim 1, wherein the capsule is a transparent capsule.

4. The system of claim 1, wherein the barrier includes a wire.

5. The system of claim 1, wherein the barrier includes at least one pair of substantially parallel wires that contain the plurality of object.

6. The system of claim 1, wherein the sorting camera and the first and second inspection cameras are complementary metal-oxide semiconductor (CMOS) cameras.

7. The system of claim 1, further including:

a cup conveyor including a plurality of open-ended cups, wherein each of the plurality of open-ended cups receives one of the plurality of objects and transports its associated object through an intermediate inspection area;

a first inspection camera for capturing an image of a first end of each of the plurality of objects as the plurality of objects move through the intermediate inspection area;

a second inspection camera for capturing an image of a second end of each of the plurality of objects as the plurality of objects move through the intermediate inspection area, wherein the second end of each of the plurality of objects is opposite the first end of each of the plurality of objects;

at least one intermediate rejection valve, the intermediate rejection valve functioning to direct an intermediately defective object with at least one defective end such that the intermediately defective object is separated from an inspection stream, wherein the cup conveyor, the first and second inspection cameras and the at least one intermediate rejection valve are coupled to and controlled by the processor; and a direction chute for receiving the objects with acceptable ends and directing them onto the feed conveyor.

8. The system of claim 7, further including:

a hopper for receiving the plurality of objects, the hopper providing the objects to the cup conveyor responsive to the processor.

9. The system of claim 7, wherein the sorting camera and the first and second inspection cameras are charge-coupled device (CCD) cameras.

10. The system of claim 7, further including:

a plurality of electric motors coupled to the processor, the plurality of electric motors for driving the feed conveyer, the cup conveyor, and the hopper responsive to the processor; and a plurality of encoders coupled to the processor, the encoders providing an indication of the speed of an associated one of the motors and hence the associated speed of the feed conveyor and the cup conveyor, wherein the processor sets a sorting scan rate for the sorting camera responsive to the speed of the feed conveyor and an inspection scan rate for the first and second inspection cameras responsive to the speed of the cup conveyor.

11. An object sorting system for automatically inspecting a plurality of objects and sorting acceptable objects from defective objects, the system comprising:

a feed conveyer for receiving a first plurality of objects, the feed conveyor moving the first plurality of objects through an inspection area;

a barrier placed across a top surface of the feed conveyer, wherein the barrier defines a boundary of the inspection area and is configured to redirect the first plurality of objects and cause the first plurality of objects to rotate about an object axis;

a sorting camera positioned for capturing an image of each of the first plurality of objects as the first plurality of objects rotate and move through the inspection area;

at least one final rejection valve, the at least one final rejection valve functioning to separate finally defective objects and inspected acceptable objects; and a processor coupled to the feed conveyer, the sorting camera and the at least one rejection valve, wherein the processor executes an inspection routine that controls a speed of the feed conveyer, a scanning rate of the sorting camera and actuation of the at least one final rejection valve, wherein the first plurality of objects are spherical.

12. A method for automatically inspecting a plurality of objects and sorting acceptable objects from defective objects, the method comprising the steps of:

receiving a plurality of objects;

rotating and moving the objects through an inspection area;

capturing an image of each of the plurality of objects as the plurality of objects move through the inspection area;

comparing the captured image of each of the plurality of objects to at least one stored image to determine whether an object is defective; and directing a defective object such that the defective object is separated from inspected acceptable objects, wherein the plurality of objects are one of a bolt, an engine valve, a capsule, a ball bearing and a medical ball.

13. The method of claim 12, wherein the plurality of objects are rotated by a barrier which is placed across a feed conveyor that moves the objects through the inspection area, and wherein the angle at which the barrier is placed across the feed conveyor is adjusted in conjunction with the speed of the feed conveyor to achieve a desired rate of rotation for the plurality of objects.

14. The method of claim 12, wherein the plurality of objects include at least one surface that is cylindrical.

15. A method for automatically inspecting a plurality of objects and sorting acceptable objects from defective objects, the method comprising the steps of:

receiving a plurality of objects;

rotating and moving the objects through an inspection area;

capturing an image of each of die plurality of objects as the plurality of objects move through the inspection area;

comparing the captured image of each of the plurality of objects to at least one stored image to determine whether an object is defective; and directing a defective object such that the defective object is separated from inspected acceptable objects, wherein the plurality of objects are spherical.

16. An capsule sorting system for automatically inspecting a plurality of capsules and sorting acceptable capsules from defective capsules, the system comprising:

a feed conveyer for receiving a first plurality of capsules, the feed conveyor moving the first plurality of capsules through an inspection area;

a barrier placed across and above a top surface of the feed conveyer, wherein the barrier defines a boundary of the inspection area and is configured to redirect the first plurality of capsules and cause the first plurality of capsules to rotate about a capsule axis;

a sorting camera for capturing an image of each of the first plurality of capsules as the first plurality of capsules rotate and move through the inspection area;

at least one final rejection valve, the at least one final rejection valve functioning to separate finally defective capsules and inspected acceptable capsules; and a processor coupled to the feed conveyer, the sorting camera and the at least one final rejection valve, wherein the processor executes an inspection routine that controls a speed of the feed conveyer, a scanning rate of the sorting camera and the at least one final rejection valve.

17. The system of claim 16, wherein an angle at which the barrier is placed across the feed conveyor is adjusted in conjunction with the speed of the feed conveyor to achieve a desired rate of rotation for the first plurality of capsules.

18. The system of claim 16, wherein the first plurality of capsules are transparent.

19. The system of claim 16, wherein the first plurality of capsules include at least one surface that is cylindrical.

20. The system of claim 16, wherein the first plurality of capsules are transparent and include at least one surface that is cylindrical.

21. The system of claim 16, wherein the barrier includes a wire.

22. The system of claim 16, wherein the barrier includes at least one pair of substantially parallel wires that contain the first plurality of capsules.

23. The system of claim 16, further including:

a hopper for receiving the plurality of capsules, the hopper providing the capsules to the cup conveyor responsive to the processor.

24. The system of claim 16, wherein the sorting camera and the first and second inspection cameras are complementary metal-oxide semiconductor (CMOS) cameras.

25. The system of claim 16, further including:

a cup conveyor including a plurality of open-ended cups, wherein each of the plurality of open-ended cups receives one of the plurality of capsules and transports its associated capsule through an intermediate inspection area;

a first inspection camera for capturing an image of a first end of each of the plurality of capsules as the plurality of capsules move through the intermediate inspection area;

a second inspection camera for capturing an image of a second end of each of the plurality of capsules as the plurality of capsules move through the intermediate inspection area, wherein the second end of each of the plurality of capsules is opposite the first end of each of the plurality of capsules;

at least one intermediate rejection valve, the at least one intermediate rejection valve functioning to direct a defective capsule with at least one defective end such that the defective capsule is separated from capsules with acceptable ends, wherein the cup conveyor, the first and second inspection cameras and the at least one intermediate rejection valve are coupled to and controlled by the at least one processor; and a direction chute for receiving the capsules with acceptable ends and directing them onto the feed conveyor.

26. The system of claim 25, wherein the sorting camera and the first and second inspection cameras are charge-coupled device (CCD) cameras.

27. The system of claim 25, further including:

a plurality of electric motors coupled to the processor, the plurality of electric motors for driving the feed conveyer and the cup conveyor responsive to the processor; and a plurality of encoders coupled to die processor, the encoders providing an indication of the speed of an associated one of the motors and hence the associated speed of the feed conveyor and the cup conveyor, wherein the processor sets a sort scan rate for the sorting camera responsive to the speed of the feed conveyor and an inspection scan rate for the first and second inspection cameras responsive to the speed of the cup conveyor.

* * * * *

UNITED STATES PATENT AND TRADEMARK OFFICE

CERTIFICATE OF CORRECTION

PATENT NO. : 6,805,245 B2
DATED : October 19, 2004
INVENTOR(S) : Ernest K. Kenneway It is certified that error appears in the above-identified patent and that said Letters Patent is hereby corrected as shown below:

Column 6,
Line 44, "object" should be -- objects --;

Column 8,
Line 16, "die" should be -- the --; and

Column 10,
Line 15, "die" should be -- the --.

Signed and Sealed this

Twenty-eighth Day of June, 2005

JON W. DUDAS
*Director of the United States Patent and Trademark Office*